US006898923B2

(12) United States Patent
Gelardi

(10) Patent No.: US 6,898,923 B2
(45) Date of Patent: May 31, 2005

(54) DISC PACKAGING

(75) Inventor: John A. Gelardi, Kennebunkport, ME (US)

(73) Assignee: Sagoma Plastics Corporation, Biddeford, ME (US)

( * ) Notice: Subject to any disclaimer, the term of this patent is extended or adjusted under 35 U.S.C. 154(b) by 0 days.

(21) Appl. No.: 10/166,009

(22) Filed: Jun. 11, 2002

(65) Prior Publication Data

US 2002/0194821 A1 Dec. 26, 2002

Related U.S. Application Data

(60) Provisional application No. 60/296,759, filed on Jun. 11, 2001.

(51) Int. Cl.[7] ..... B65B 11/00

(52) U.S. Cl. ..... 53/462; 53/445; 53/449; 53/491

(58) Field of Search ..... 53/237, 238, 254, 53/445, 449, 452, 461, 462, 484, 491

(56) References Cited

U.S. PATENT DOCUMENTS

| | | | |
|---|---|---|---|
| 4,685,277 | A | 8/1987 | Ilsemann |
| 4,852,327 | A | 8/1989 | Kurkowski et al. |
| 4,881,356 | A | 11/1989 | Beezer et al. |
| 5,163,271 | A | 11/1992 | Pan et al. |
| 5,207,050 | A | 5/1993 | Fulkerson et al. |
| 5,285,620 | A | 2/1994 | Kaye et al. |
| 5,341,624 | A | 8/1994 | Kaye |
| 5,561,962 | A | 10/1996 | Everhard et al. |
| 5,664,405 | A | 9/1997 | Perego |
| 5,788,114 | A | 8/1998 | Perego |
| 5,816,028 | A | 10/1998 | Zaniboni |
| 5,875,614 | A | 3/1999 | Youngs et al. |
| 5,943,845 | A | 8/1999 | Ilsemann |
| 6,032,435 | A | 3/2000 | Zaniboni |
| 6,035,605 | A | 3/2000 | Perego |
| 6,238,172 | B1 | 5/2001 | Onishi |

*Primary Examiner*—Louis Huynh
(74) *Attorney, Agent, or Firm*—James Creighton Wray; Meera P. Narasimhan

(57) ABSTRACT

Creased paper board packages are unstacked, separated and conveyed. Discs are loaded into dimensionally controlled trays using relatively fine alignment, placement and assembly tolerances. Subsequently, the disc-loaded trays are assembled onto less dimensionally controlled tray-holding panels on creases paper boards using relatively less stringent tolerances. Booklets are inserted in pockets in panels adjacent the disc-holding panels, and the paper board packages are closed.

19 Claims, 3 Drawing Sheets

DISC PACKAGING

This application claims the benefit of U.S. Provisional Application No. 60/296,759, filed Jun. 11, 2001.

BACKGROUND OF THE INVENTION

Prior art disc packaging machines place the trays on the cover panels and then the discs on the pre-attached trays. This necessitates precise alignment of cover panels and precise positioning of trays on panels so that the discs may be automatically pushed onto rosettes. Misalignments of discs and rosettes by more than 0.006 of an inch stop the machines. The result requires long and expert set up time for proper automatic disc placement and creates a significant amount of down time, resulting in economic loss.

Needs exist for improved disc packaging.

SUMMARY OF THE INVENTION

In the present invention, a CD or DVD package is assembled by assembling discs on trays in one line and concurrently in a second line unstacking cover panels followed by applying glue on the panels. The trays which carry the disks are then placed on the glued panels. The panels with the pre-loaded trays are inspected and then closed.

The panels may have multiple sections, and the disc-loaded trays may be placed in the desired sections under the control of electronic controls. For example, the panels may have from two to four sections, and the disks may be placed on any of sections one, two, three or four.

Two or more disks and trays may be placed on different sections of the same panel.

The advantage of loading the discs in the trays and then loading the trays onto the pre-glued panels is the broadened dimensional tolerance for placement of the loaded trays on the glued panels. The broadened tolerances translate into reduced set up time by less skilled workers and reduced machine shut downs. One worker may operate several machines, resulting in improved economics in disc packaging.

Qualifications for placement of discs on trays are exaggerated by having a tray already fixed on a cover panel. The new invention provides off line loading of discs on trays.

1/16-inch deviations of placement on trays are visually acceptable. The placement of a tray can be in one of four positions on the panel board. The placement of a loaded tray on a panel board has a relatively large tolerance of +/−1/16-inch max (+/−0.062 inches). The small tolerances of 0.006 inches for placing a disc on a pre-placed tray require twice the set up time and produces four times the down time. When a disc will not go onto a rosette, a machine stops.

A tray is dimensionally accurate to +/−0.002 inches. A board may vary in size by about 0.014 inches and may change in size according to ambient moisture conditions. When a tray is placed on a board, the tray placement may be off by 0.006 inches or more. Excessive set up time for precise control and down time by machine stoppage is caused by putting trays onto panels first. More operators and more machines are required for multiple use formats. By putting discs on trays first, a singe operator may tend more machines. Each machine may be quickly changed for multiple tray formats.

The outer graphic sheets may be plastic or paper board. Paper board may change tolerances. Costs of the boards are reduced by not requiring precise size tolerances. Packages may contain two or more trays, which may contain 4, 8, or 12 discs being packaged in a panel, spine, panel, spine, panel sandwich manner.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
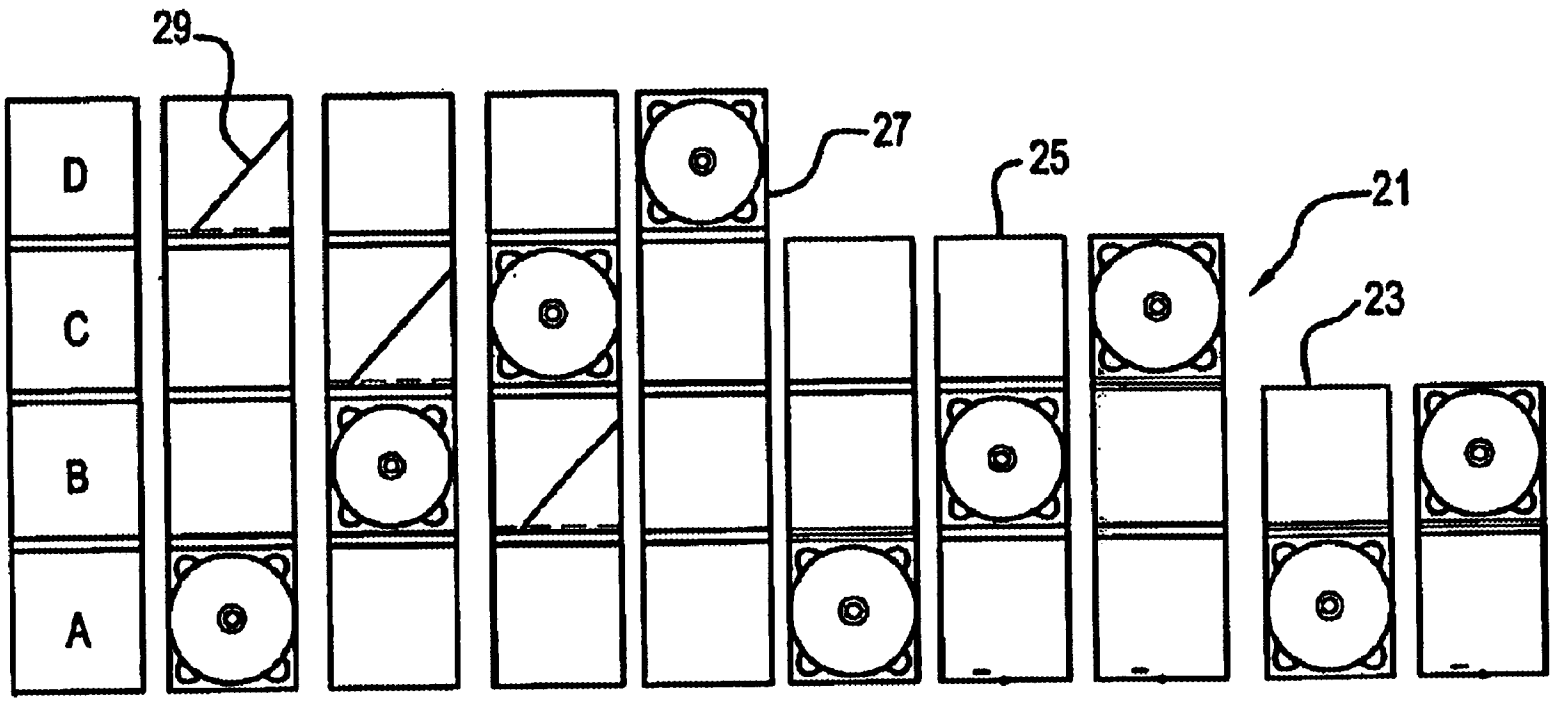
FIG. 1 is a diagram showing the disc placement zones.

FIG. 1 shows the disc-loaded tray 21 placement zones. The package can be a two-panel package 23, three-panel package 25, or four-panel package 27. The disc-loaded tray 21 placement may occur in zone A, B, C or D. Booklet insertion in pockets 29 may occur in zone B, C, or D. The closed product exits in lane A or B.

Figure 2:
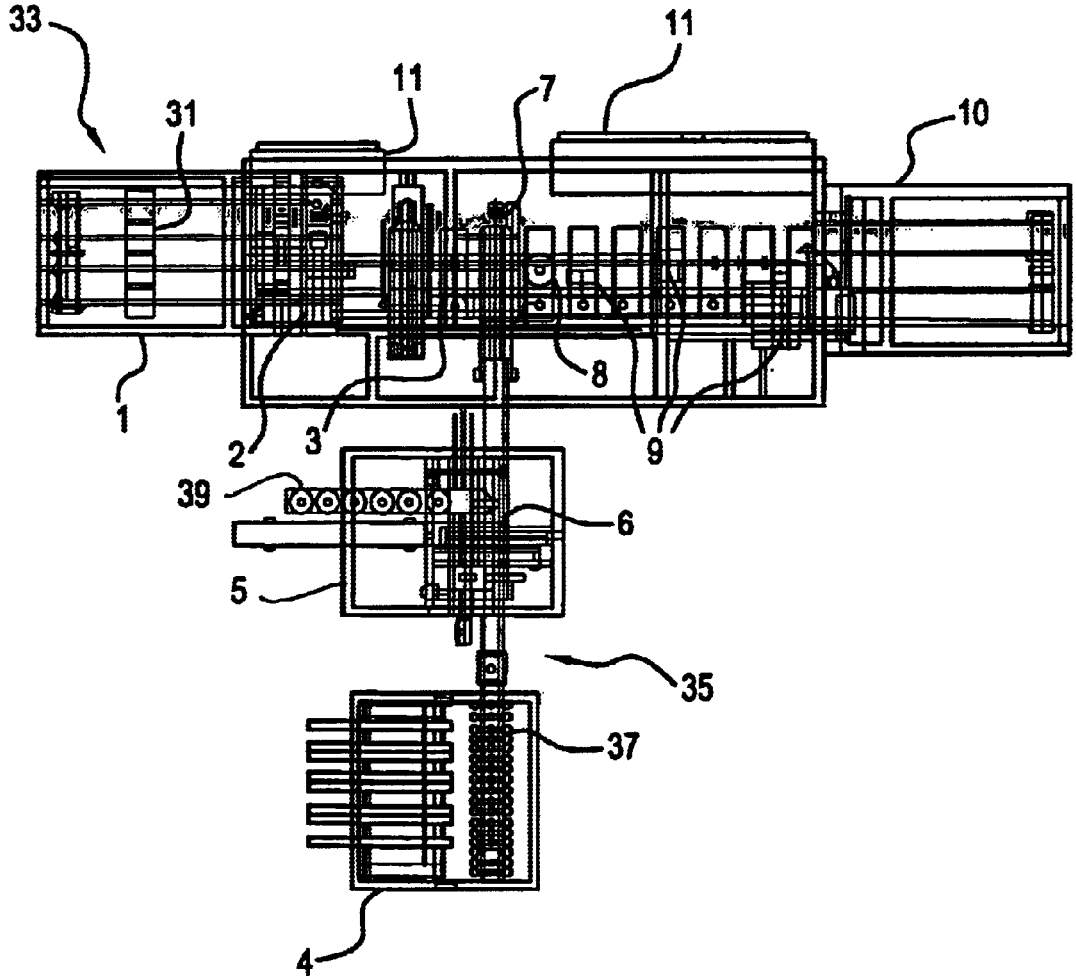
FIG. 2 is a diagram showing the disc package assembly for one disc.

FIG. 2 shows the disc package assembly for packaging single discs into packages. Boards 31 are drawn from the bottom of a stack and are shingled or feathered on board infeed 1. On the main line 33, the boards 31 are stripped from the bottom of the shingled array on infeed 1 at board stripper station 2. At glue station 3, glue is deposited on an appropriate panel which receives a tray which has been loaded concurrently on a lateral line 35. Trays 37 are stacked in the tray buffer 4 and are moved inward to the disc buffer 5. The disc buffer aligns discs for loading. The discs 39 are loaded into the trays at the disc placement station 6. The packaging cover panel sheet material has been loaded at the board infeed with buffer 1. The board strip station 2 has taken one board 31 from the stack of boards. The glue station 3 has prepared the board to receive the disc-loaded tray 21. The disc-loaded tray 21 is brought in from the disc placement station 6 and is glued onto the packaging at the disc-loaded tray placement station 7. The package is inspected at the inspection station 8, and the package is then folded and closed at the closing stations 9. The closing stations 9 have seven different closing operations depending on which type of packaging is used, two-panel, three-panel, or four-panel. The folded and closed packages exit on exit conveyor 10.

Figure 3:
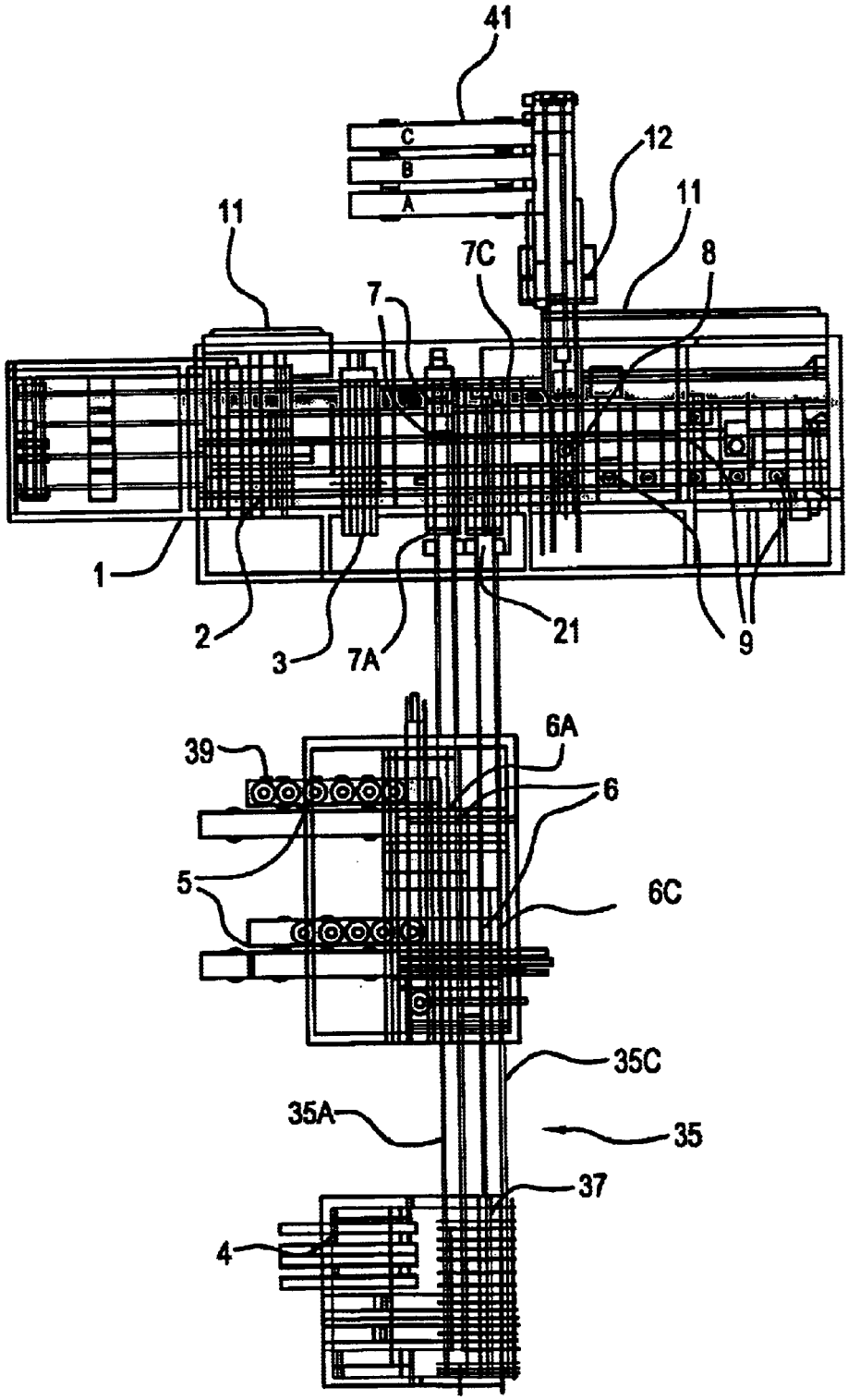
FIG. 3 is a diagram showing the disc package assembly for two discs.

FIG. 3 shows the disc package assembly for packages containing two discs. The board infeed with buffer 1 unloads the boards, and the board strip station 2 separates and prepares one board from a stack of boards for gluing and for the arrival of the disc-loaded trays 21. The glue station 3 has dual heads, which prepare the board 31 for receiving two disc-loaded trays at the tray with disc placement stations 7. Tray placement station 7 is separated into two stations 7A and 7C for placing disc-loaded trays on panels A and C of a four-panel package board 27 such as shown in FIG. 1.

Lateral line 35 is divided into two lanes with conveyors 35A and 35C, which respectively serve stations 7A and 7C. The tray buffer 4 loads trays 37 onto both of the tray conveyors 35A and 35C. The disc buffer 5 has two loading mechanisms 6 and loads one disc 39 into each tray at the disc placement stations 6A and 6C. The discs in the trays then go to the tray placement stations 7A and 7C having two points of arrival.

In multiple disc packages, the tray buffer releases a second tray, which is loaded onto the lane C or D tray conveyor 35. A second disc is placed in the tray at the disc placement station 6C or 6D. This disc-loaded tray is glued onto the board in the C or D position at the tray with disc placement station 7C or 7D.

Alternatively, several discs may be mounted on a single multiple layer tray at station 6 and the single loaded tray may be mounted on the cover sheet at station 7. The sizes of the spines are increased to accommodate the thicker multiple disc trays.

The booklet infeed conveyors 41 allow booklets to be placed in a pocket 29 in the A, B, or C position on the board, as shown in FIG. 1. The booklet is placed in the package at the booklet insertion station 12. The package is then inspected at the inspection station 8 and sent to the closing stations 9 consisting of five separate closing mechanisms depending on how the package is composed. Settings are changed in the electronic control panels 11 to adjust for the number of panels in each package and the desired positions of the loaded trays and the booklets in each package.

The tray loading occurs at the disc loading station 6. The plastic trays and plastic discs can be assembled easily, using the precise dimension control and reference of the plastic surfaces, readily meeting the tolerances of 0.006 inches for alignment of the disc openings with the tray rosettes.

When the loaded trays are positioned over the package boards for assembly, a two and one half times greater tolerance of 0.016 inches is permitted for mounting the loaded trays on the paper boards, having varied reference surfaces. The result is less machine stopping for out of tolerance products.

The invention is a process for assembling a CD or DVD package. Formed printed sheet material is constructed with multiple panels. Trays holding compact discs are attached to the sheet material, and the package is closed.

The formed multi panel sheet material infeed into the machine uses adhesive, which is applied to the multi panel sheet. Discs are placed into trays mechanically or to adhesive on formed multi panel sheet forming disc-tray assemblies. Disc-tray assemblies are placed onto the sheet material. Printed information cards or booklets are combined with the packages. The packages leave the machine open or closed.

Combing the disc into the tray before the tray is placed onto the board decreases the complexity of an assembly machine and lowers cost, set up time, size of the machine and its complexity.

While the invention has been described with reference to specific embodiments, modifications and variations of the invention may be constructed without departing from the scope of the invention, which is defined in the following claims.

I claim:

1. A process of fixing a disc in a disc package comprising advancing linearly a multiple panel paperboard package pre-assembly, placing adhesive on at least one panel of the multiple panel paperboard package, moving a disc carrier tray perpendicular to the advancing paperboard package, moving a disc parallel to the advancing of the paperboard package and aligning the disc with the carrier tray as the carrier tray moves in the perpendicular direction, precisely positioning the disc on the carrier tray with close tolerances, assembling the disc on the carrier tray and forming a loaded disc-holding assembly, moving the loaded disc-holding assembly linearly in the perpendicular direction to the paperboard package, less precisely aligning and positioning the loaded disc-holding assembly and the paperboard package, placing the loaded disc-holding assembly on the adhesive on the panel of the paperboard package and completing assembly of the disc package.

2. The process of claim 1, further comprising closing the assembled disc package.

3. The process of claim 1, wherein the multiple panel paperboard package has a base panel and a cover panel and a spine panel interposed between the base panel and the cover panel and wherein the placing adhesive comprises placing adhesive on the base panel and the placing of the loaded disc-holding assembly comprises placing the loaded disc-holding assembly on the adhesive on the base panel.

4. The process of claim 3, further comprising folding the spine panel around the disc-holding assembly, and folding the cover panel over the disc-holding assembly.

5. The process of claim 4, further comprising inserting a booklet in a pocket in the cover panel before the folding of the spine panel.

6. The process of claim 1, wherein the carrier tray is a plastic tray and the assembling of the disc on the carrier tray comprises loading the disc into the carrier tray.

7. The process of claim 1, wherein the carrier tray has a rosette and wherein the assembling comprises snapping the disc on the rosette.

8. The process of claim 1, wherein the multiple panel paperboard package has multiple loaded disc-holding carrier assembly-receiving panels, and wherein the pre-assembling comprises pre-assembling multiple discs on multiple carriers and forming multiple disc-holding assemblies, and the placing comprises placing the multiple disc-holding assemblies on the multiple assembly-receiving panels.

9. The process of claim 1, wherein the carrier tray has a base, sidewalls, a central disc-receiving well and a rosette centered in the well, and wherein the disc is snapped onto the rosette and is positioned in the well before attaching the loaded disc-holding assembly on the adhesive on the at least one panel.

10. A method of assembling a CD or DVD disc-holding package comprising precisely placing and loading a disc in a carrier using close tolerances and creating a loaded disc-holding assembly, moving a multiple panel paperboard package linearly along a conveyor, moving the loaded disc-holding assembly linearly in a direction perpendicular to the conveyor toward the paperboard package, aligning and positioning with wider tolerances and mounting the loaded disc-holding assembly on the paperboard package and thereby creating the disc-holding package.

11. The method of claim 10, further comprising closing the disc-holding package.

12. The method of claim 10, further comprising providing the multiple panel paperboard package with a base panel and a cover panel and a spine panel interposed between the base panel and the cover panel, placing adhesive on the base panel, and wherein the mounting of the loaded disc-holding assembly on the paperboard package comprises mounting the loaded disc-holding assembly on the adhesive on the base panel.

13. The method of claim 12, further comprising folding the spine panel around the disc-holding assembly, and folding the cover panel over the disc-holding assembly.

14. The method of claim 13, further comprising inserting a booklet in a pocket in the cover panel before the foldings.

15. The method of claim 10, wherein the carrier is a plastic tray and the loading comprises loading the disc in the tray.

16. The method of claim 10, comprising providing the tray with a rosette, and wherein the assembling comprises snapping the disc on the rosette.

17. The method of claim 10, further comprising providing the multiple panel paperboard package with multiple loaded disc-holding assembly-receiving panels, wherein the pre-assembling further comprises pre-assembling multiple discs on multiple carriers, and wherein the mounting comprises mounting the multiple disc-holding assemblies on the multiple assembly-receiving panels.

18. A method of forming disc-holding paperboard packages comprising unstacking creased paperboards having creases separating relatively large panels and interposed spine panels, moving the creased paperboards in a first linear direction, moving disc carriers perpendicularly to the paperboards, moving discs parallel to the paperboards, precisely positioning and loading the discs into the disc carriers using relatively close tolerances between the carriers and the discs and thereby assembling preloaded disc carriers, moving the preloaded disc carriers in a linear direction perpendicular to the first linear direction, attaching the preloaded disc carriers to the relatively large panels of the paperboards using relatively relaxed tolerances and thereby forming disc-holding paperboard packages.

19. The process of claim 18, wherein the carriers are carrier trays having bases, sidewalls, central disc receiving wells and rosettes centered in the wells and wherein in the loading comprises snapping the discs onto the rosettes and positioning the discs in the wells, thereby assembling preloaded disc carrier trays before attaching the preloaded disc carrier trays to the relatively large panels of the paperboards.

* * * * *